US005160915A

United States Patent [19]

Kiss

[11] Patent Number: 5,160,915

[45] Date of Patent: Nov. 3, 1992

[54] WIRELESS BISTATIC LINK INTRUSION DETECTION SYSTEM

[76] Inventor: Michael Z. Kiss, 418 S. Meadows Ave., Manhattan Beach, Calif. 90266

[21] Appl. No.: 588,948

[22] Filed: Sep. 26, 1990

[51] Int. Cl.[5] ..... G08B 13/18

[52] U.S. Cl. ..... 340/552; 340/553; 340/541; 340/825.11; 340/518

[58] Field of Search ..... 340/552, 553, 554, 555, 340/518, 541, 825.1, 825.11

[56] References Cited

U.S. PATENT DOCUMENTS 3,711,846 1/1973 Schlisser ..... 340/552
3,733,602 5/1973 Cuckler ..... 340/552
3,967,258 6/1976 Bucy, Jr. ..... 340/556
4,124,848 11/1978 Clark ..... 340/552
4,358,756 11/1982 Morel ..... 340/554
4,964,065 10/1990 Hicks ..... 340/552

*Primary Examiner*—Jin F. Ng
*Assistant Examiner*—Christine K. Oda
*Attorney, Agent, or Firm*—Freilich Hornbaker Rosen

[57] ABSTRACT

An intrusion detection system employing multiple bistatic microwave links and wireless means for remotely interrogating each link to provide alarm and status information at a central station.

21 Claims, 11 Drawing Sheets

WIRELESS BISTATIC LINK INTRUSION DETECTION SYSTEM

FIELD OF THE INVENTION

This invention relates generally to intrusion detection systems using multiple bistatic detectors.

BACKGROUND OF THE INVENTION

Various bistatic intrusion detectors exist for detecting the intrusion of persons or equipment across a line; e.g. a border or area perimeter. Exemplary detectors are discussed in the following U.S. Pat. Nos.: 2,203,807, 3,237,105, 3,618,083, 3,618,091, 3,696,368, 3,877,002, 4,605,922, 4,697,184. A bistatic detector is comprised of a microwave transmitter and receiver, which, when deployed, are typically spaced from one another by several hundred feet. Processor means monitors the microwave energy received by the receiver and interprets a signal variation greater than a certain threshold as constituting an intrusion or alarm condition.

SUMMARY OF THE INVENTION

The present invention is directed to an improved intrusion detection system employing multiple bistatic links and wireless means for remotely interrogating each link to provide alarm information at a central station.

In accordance with a preferred embodiment, a plurality of identical sector sets are provided each forming a pair of bistatic microwave links. Each sector set is comprised of a sector module and first and second transmit modules which together form left and right bistatic links. The sector module includes oppositely oriented first and second receive antennas and supporting electronics. Each of the sector and transmit modules is physically configured so as to be readily remotely deployed, each module including a self contained battery and solar charging panel.

In accordance with one significant aspect of the invention, each transmit module encodes status information on the microwave carrier it transmits to the sector control module. The status information is indicative, of operating conditions (i.e. normal or fault) at the transmit module such as tampering, low battery voltage, etc. The transmitted carrier and status information is received at the sector module and processed and decoded to yield both alarm and status outputs.

Each sector module is periodically interrogated (e.g. at approximately 2.5 second intervals by UHF transmission) from a central station and responds by reporting alarm information for both its left and right links, as well as status information for itself and its associated transmit modules.

In accordance with a preferred embodiment of the invention, the central station includes means for displaying the status of each system link as well as the accumulated number of alarms incurred for each link. This accumulated number enables an operator to better determine the appropriate countermeasures to be taken.

In accordance with a still further aspect of the preferred embodiment, the central station includes means for transmitting acquired alarm information for each link to a portable remote receiver which can be readily carried by field personnel in a position to respond to an intrusion.

DETAILED DESCRIPTION

Figure 1:
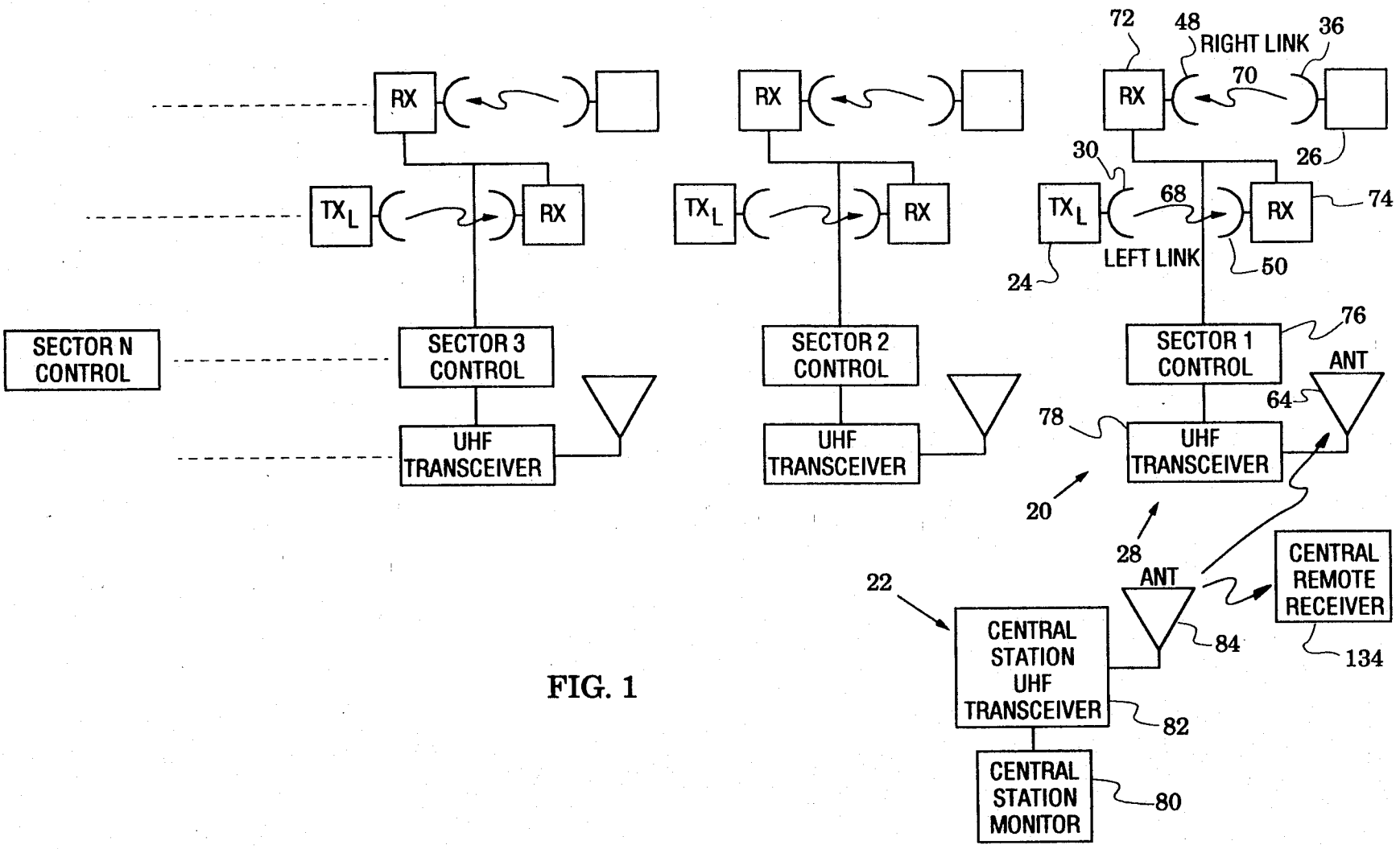
FIG. 1 is a block diagram of an intrusion detection system in accordance with the invention comprised of multiple sector sets and a central control station set.

Attention is initially directed to FIG. 1 which comprises a block diagram of a preferred wireless intrusion detection system in accordance with the invention. The system is comprised of a plurality (1,2,3, - - - N) of identical sector sets 20 and a central station 22 for interrogating and monitoring each sector set.

Each sector set 20 includes first and second transmit modules 24 and 26, and a receiver means (hereinafter, sector module) 28. Whereas FIG. 1 depicts the sector set 20 in block diagram form, FIG. 3 better illustrates the physical configuration of a preferred sector set in accordance with the present invention. More specifically, the transmit module 24 is comprised of a microwave transmit antenna 30 connected via electric cable 31 to supporting electronics housed in cabinet 32 having a tiltable solar panel 34. The transmit module 26 is identical to the transmit module 24, and likewise includes a transmit antenna 36, connected by cable 38 to supporting electronics housed in cabinet 40 bearing solar panel 42. Systems in accordance with the invention are intended for use in rapid deployment situations and consequently, antennas 30,36 in FIG. 3 are preferably mounted on portable collapsible tripods 44,46.

The sector module 28 is comprised of first and second microwave receive antennas 48,50, respectively mounted on portable collapsible tripods 52,54. The receive antennas 48,50 are respectively connected via electric cables 56,58 to supporting electronics within cabinet 60, bearing solar panel 62. the sector module 28 additionally includes a radio frequency (RF), preferably UHF, transceiver antenna 64 connected by cable 66 to supporting electronics in cabinet 60.

Figure 3:
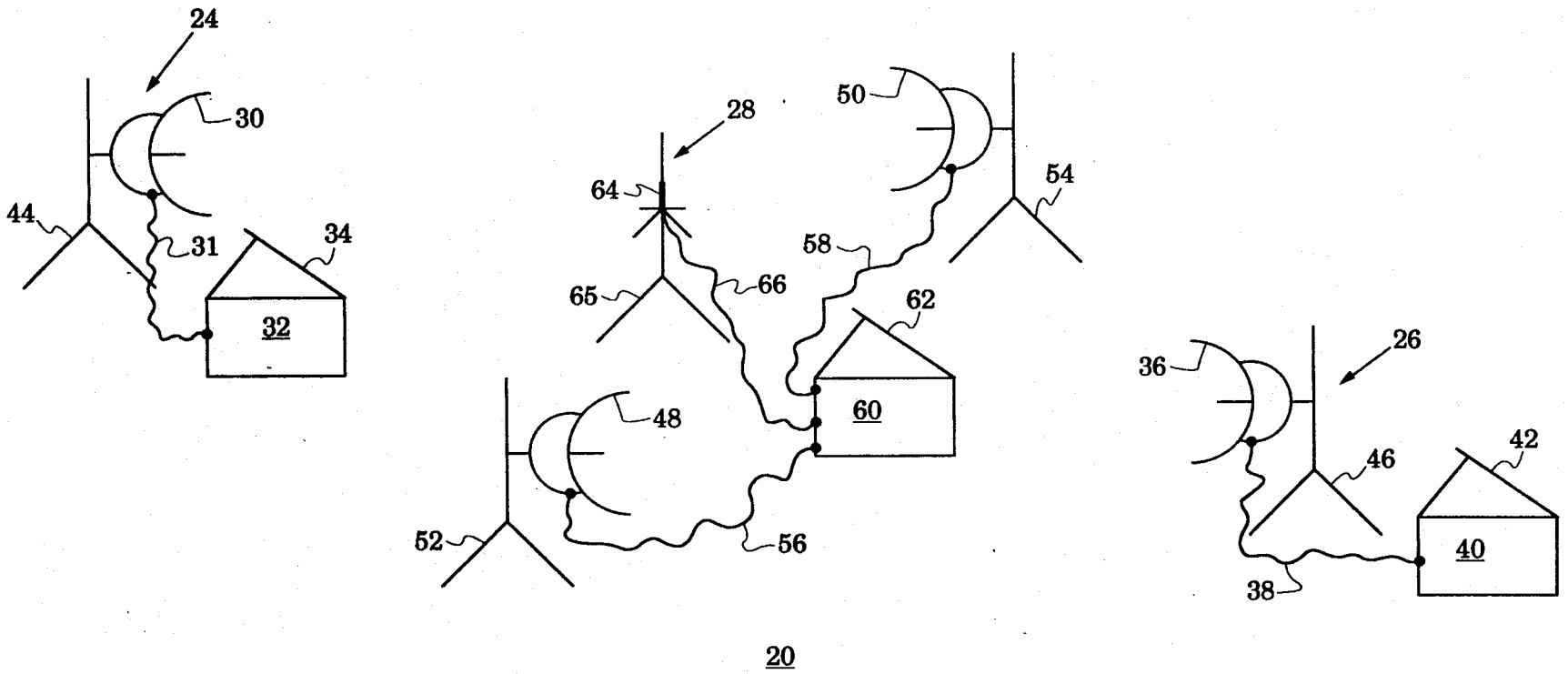
FIG. 3 schematically depicts a preferred sector set in accordance with the invention showing its sector control module and first and second transmit modules.

With reference to FIGS. 1 and 3, note that transmit antenna 30 is oriented toward receive antenna 50 to define a first (left) microwave link 68. Similarly, transmit antenna 36 is oriented toward receive antenna 48 to define a second (right) microwave link 70.

In a preferred installation for monitoring intrusion of persons or equipment across a boundary or perimeter line, (hereinafter sometimes referred to as a detection boundary) the receive and transmit antennas shown in FIGS. 1 and 3 are located substantially along the line to be monitored. Preferably, the links, e.g. 68,70 (FIG. 1) overlap along the detection boundary to assure contiguous link to link coverage.

With continuing reference to FIG. 1, note that the sector module 28 includes first and second receiver sections 72,74 respectively connected to the aforementioned receive antennas 48 and 50. Additionally, the sector module 28 includes a sector control section 76 which serves both receive sections 72,74. The receive sections 72,74 and sector control section 76, which are all housed within cabinet 60, will be discussed in greater detail hereinafter in connection with FIGS. 4 and 5.

The sector control section 76 is connected to UHF antenna 64 via UHF transceiver 78 (also physically housed in cabinet 60). As will be seen hereinafter, the function of transceiver 78 and antenna 64 is to communicate with central station 22 which includes a central station monitor and display 80, a UHF transceiver 82, and a UHF antenna 84.

A system in accordance with the invention, as depicted in FIG. 1, functions to monitor the intrusion of persons and equipment across a line formed by the microwave links (e.g. 68,70) defined between microwave coupled receive and transmit antennas. Processor means to be discussed hereinafter in connection with FIG. 4, responds to a variation in the microwave signal received along a link to indicate an intrusion alarm. When interrogated by central station 22, the alarm information is transmitted to the central station. As will be seen hereinafter, link status information (i.e. normal or fault) is transmitted along with the alarm information to central station 22. Such status information indicates the operational status, e.g. tampering, low battery voltage, etc. with respect to the transmit modules 24,26, the receive sections 72,74 and the control section 76 of the sector module 28.

Figure 2B:
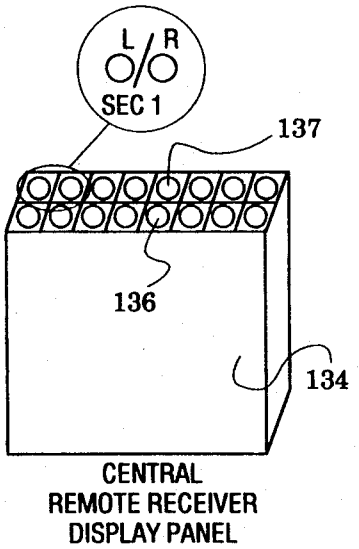
FIG. 2A schematically depicts a preferred central station display panel and FIG. 2B schematically depicts a preferred central station remote receiver display panel.
Figure 2A:
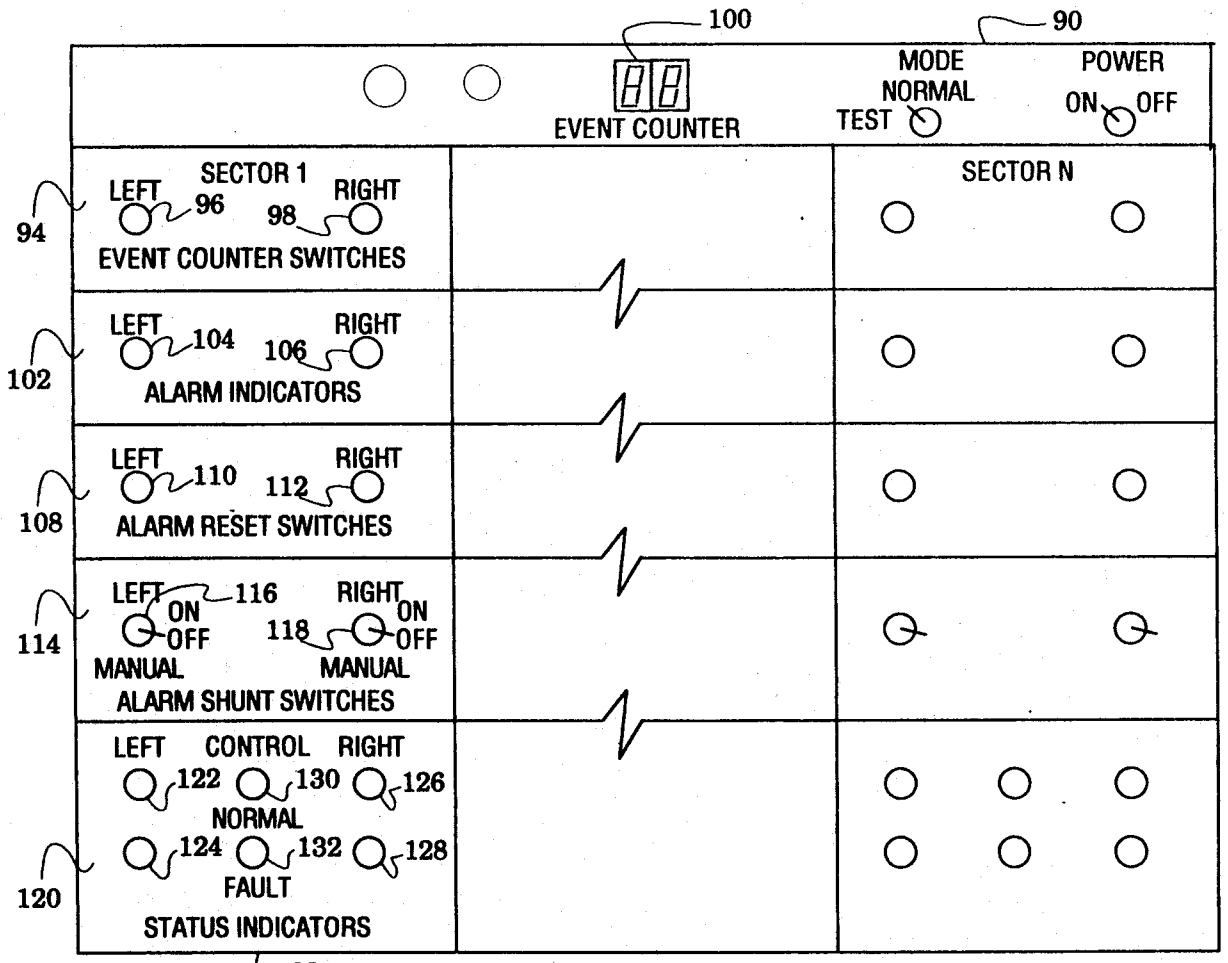

The alarm and status information received from the multiple sector sets by the control station monitor 80 is visually displayed on a display panel 90 as depicted in FIG. 2A. Note that the display panel 90 is partitioned into sector panels 92, one for each sector set 20. Because the multiple sector panels 92 are all identical, FIG. 2A only illustrates in detail the sector panel dedicated to sector set 1. Cell 94 of this panel includes left and right switches 96,98 which, when depressed, causes a number to be presented in numeric display 100 representative of the number of intrusions or alarms accumulated with respect to the associated microwave link, 68 or 70.

Cell 102 of sector panel 92 includes left and right indicator lights 104,106 which function to indicate whether or not an alarm has occurred since that link was last manually reset. Cell 108 is comprised of left and right alarm reset switches 110 and 112. Cell 114 is comprised of manual left and right switches 116,118 which enable an operator to selectively disable alarm detection with respect to a particular link. This feature is useful, for example, to permit authorized traffic across a link on a temporary basis. Cell 120 includes six indicator lights which comprise normal and fault status indicators for the left link, right link, and sector control section. More specifically, lights 122 and 124 respectively indicate normal and fault status for link 68, lights 126 and 128 define normal and fault status for link 70, and lights 130 and 132 define normal and fault status for the sector control section 76.

FIG. 1 additionally indicates a central remote receiver 134. The receiver 134 is preferably implemented in a pocket sized pager-type housing which can be readily carried by a person patrolling in the field. The central station transceiver 82 updates display panel 136 on receiver 134 to enable field personnel to quickly respond to an intrusion along the boundary. As depicted in FIG. 2B, the receiver 134 display panel 136 includes multiple alarm lights 137, each corresponding to a different system link.

Although embodiments of the invention can consist of various numbers of sectors, in the exemplary embodiment to be described herein, it will be assumed that the system accommodates eight sectors, each sector defining two bistatic microwave links. As was previously pointed out, prior art systems disclose bistatic links capable of monitoring intrusion over distances up to several hundred feet. Accordingly, the eight sector, sixteen link system assumed herein is capable of monitoring a line up to several miles in length. Each physical module, i.e. 24,26,28 of a sector set is fully self contained, operating on its own battery supply which is charged by a solar panel, as represented in FIG. 3. The modules are constructed so that they can be readily dismantled and redeployed very quickly.

Figure 4:
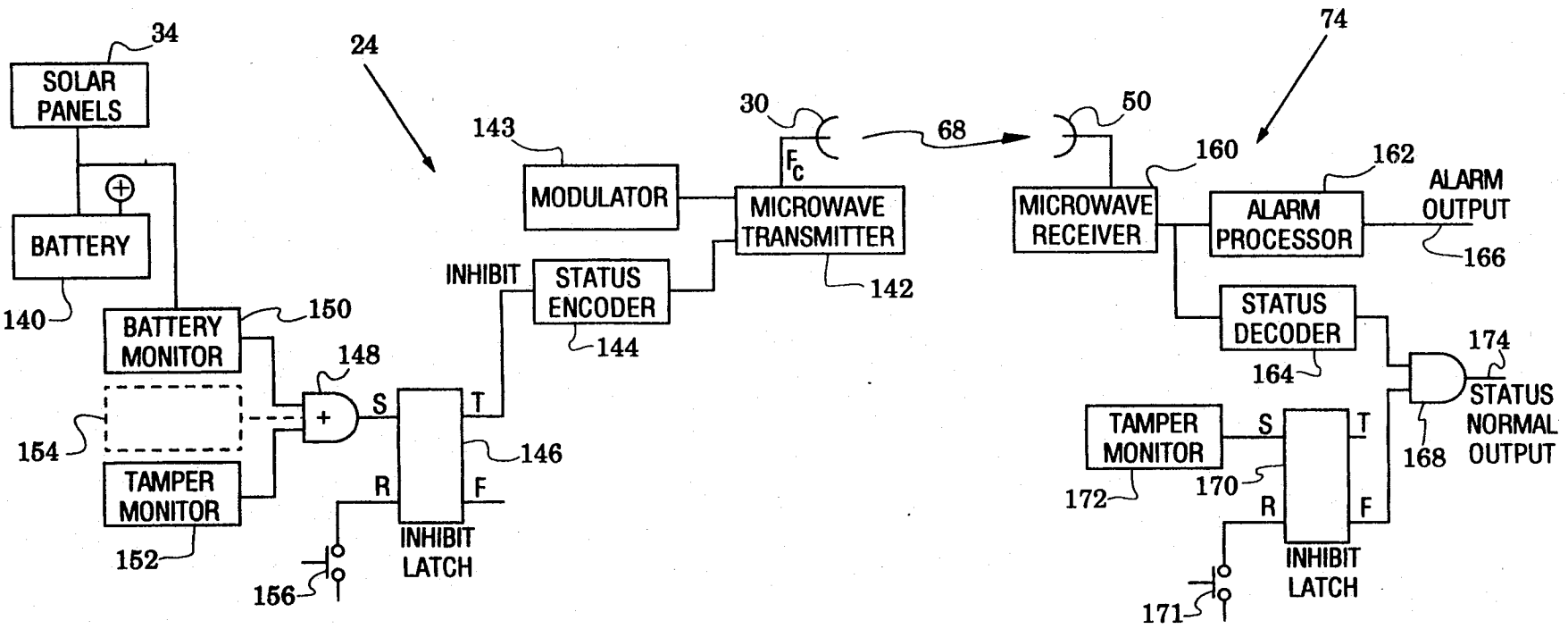
FIG. 4 is a block diagram of a preferred microwave link in accordance with the invention showing a transmit module and one receive section of a sector module.

Attention is now directed to FIG. 4 which comprises a block diagram depicting the transmit module 24 and receive section 74 of FIG. 1 which form the left microwave link 68. The transmit module 24 includes a battery power supply 140 which is charged during daylight hours by solar panel 34. Although not specifically shown, it should be understood that all of the electronic components within transmit module 24 are powered by the battery 140. The transmit module 24 includes transmitter 142 which continually supplies a microwave carrier signal $F_c$ modulated by modulator 143 to transmit antenna 30. In accordance with the present invention, a status encoder (e.g. tone modulator) 144 is provided to apply a STATUS NORMAL signal (preferably a tone) to the carrier $F_c$. The status encoder 144 can be inhibited by the output of inhibit latch 146 when the inhibit latch is set by a status fault condition. More specifically, the inhibit latch 146 will be set by any of several fault inputs to gate 148. For example, battery monitor 150 monitors the output voltage of battery 140 and provides a true output when a battery low voltage condition is sensed. In addition, monitor 152 is provided to monitor any tampering or vandalism at the transmit module 24. Either of these fault conditions, or other fault conditions which might be detected by optional monitors 154 act via gate 148 to set the inhibit latch 146 to in turn disable the status encoder 144.

It should be noted that latch 146 is represented in FIG. 4 as having set (S) and reset (R) input terminals and true (T) and false (F) output terminals. The convention adopted herein will assume that when the latch is set, output T will be logically true and output F logically false. When the latch is reset, T will be false and F will be true. Actuation of reset switch 156 resets the inhibit latch 146. When the inhibit latch 146 is reset, the status encoder 144 is no longer inhibited and the carrier signal $F_c$ will bear the STATUS NORMAL encoding.

The receive section 74 includes a receiver 160 whose output is applied to an alarm processor 162 and a status decoder 164. Although not shown in FIG. 4, the electronics of the receive section 74 is powered by a battery charged by solar panels 62 (FIG. 3).

The alarm processor 162, well known in the prior art, responds to a change (e.g. attenuation) in the carrier signal along link 68 received by receive section 74 to produce an alarm output on terminal 166.

The status decoder 164 responds to the STATUS NORMAL encoding introduced onto the carrier by encoder 144. If the STATUS NORMAL encoding is decoded, decoder 164 provides a true output signal to AND gate 168. This will result in gate 168 delivering a STATUS NORMAL output so long as the inhibit latch 170 remains reset (reset by switch 171). The inhibit latch 170 is set by monitor 172, recognizing tampering or vandalism. When inhibit latch 170 is set, its F output prevents gate 168 from delivering a STATUS NORMAL output to terminal 174.

Figure 5:
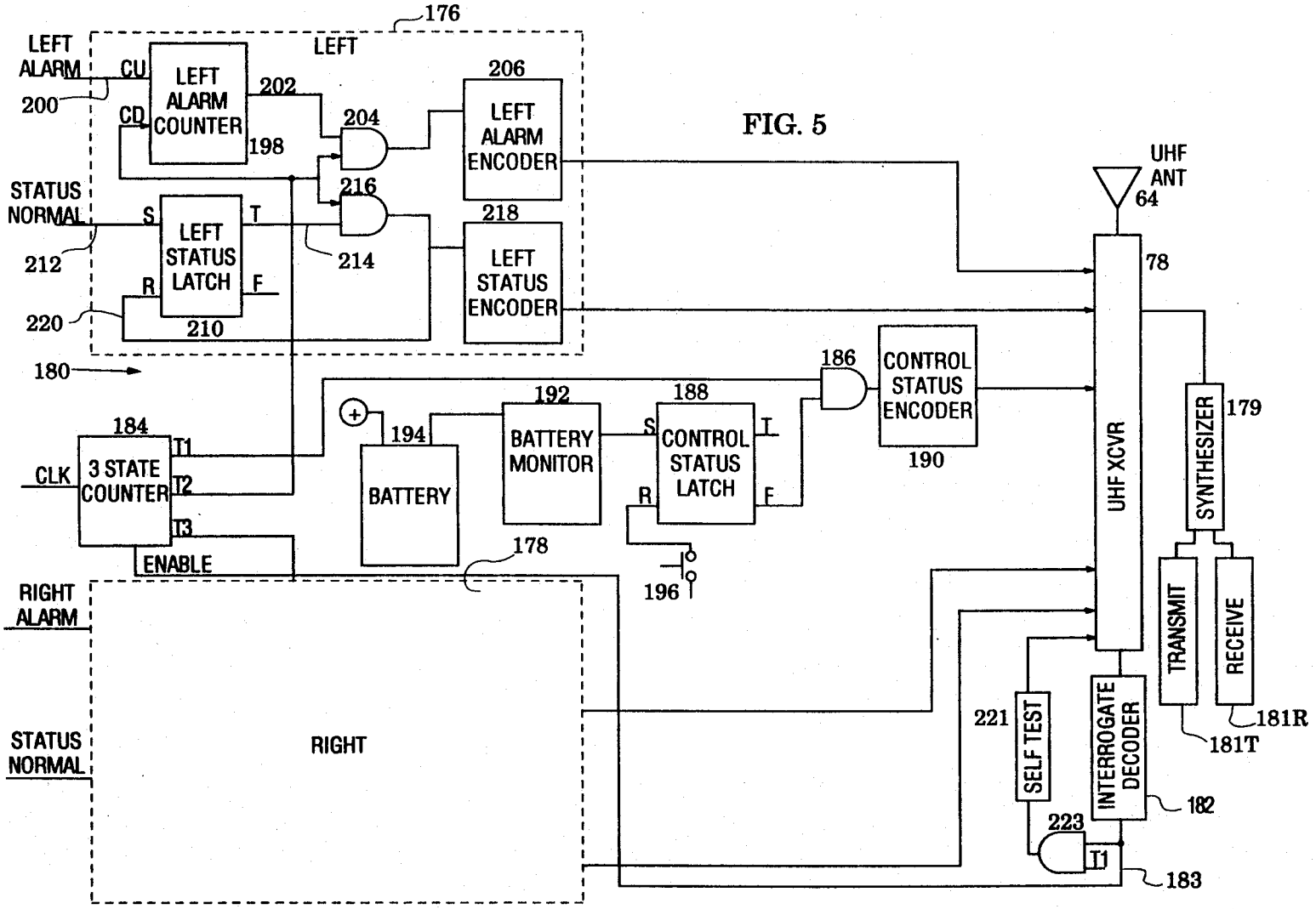
FIG. 5 is a block diagram of a preferred sector module.

FIG. 5 comprises a block diagram of the sector module 28 (FIG. 1) and is comprised of left and right portions 176, 178 (for respectively receiving the alarm and status inputs from the receive sections 72 and 74), as well as a common control portion 180. Inasmuch as the left and right portions are identical, only the left portion is represented in detail.

The sector module 28 (FIG. 5) additionally includes UHF transceiver 78 and antenna 64. Synthesizer 179 establishes the particular transmit and receive UHF carrier frequencies unique to each sector control module. These frequencies are operator selected by use of switches 181T and 181R. The received output of transceiver 78 is applied to interrogate decoder 182 which supplies an enabling output on line 183 in response to a normal interrogation command from the central station transceiver 82. The normal output of decoder 182 enables three state counter 184 to cause it to sequentially define three 50 millisecond timing intervals T1, T2, T3.

Interval T1 is employed by the common control portion 180 to produce status information indicating the operational status of the sector module 28. More specifically, during T1 AND gate 186 is enabled to pass the output (i.e. normal or fault) of control status latch 188 to control status encoder 190. Assume that latch 188 is initially reset (via switch 196) to represent normal status. Latch 188 will be set by battery monitor 192 to indicate a status fault condition in the event of insufficient battery output voltage. When gate 186 is enabled, it will enable control status encoder 190 to encode normal control status onto the carrier produced by transceiver 78.

During T2, the alarm and status information associated with left portion 176 is applied to the transceiver 78. More specifically, note that left portion 176 includes an up down counter 198. The alarm output 166 from the left link receive section 74 is connected to the count up (CU) input terminal 200 of counter 198. The counter 198 is assumed to be a unidirectional counter capable of counting upwards from 0. Output terminal 202 is true when counter 198 defines a non-zero count. Output terminal 202 is connected to the input of gate 204 which is enabled during T2. Thus, if counter 198 defines a positive non zero value, it will enable left alarm encoder 206 to supply an alarm signal to the UHF transceiver 78. Note that the T2 output of three state counter 184 is also connected to the count down (CD) input terminal 208 of counter 198. Thus, it should be understood that counter 198 is incremented each time the connected receive section (FIG. 4) supplies an alarm output to counter input terminal 200 and is decremented each time counter 184 defines interval T2. Thus, counter 198 will accumulate a number of counts equal to the number of intrusions through the associated link and each such count will be communicated via the alarm encoder 206 and transceiver 78, when the sector module 28 is interrogated.

Note that the left portion 176 also includes a status latch 210 which is set by the STATUS NORMAL output 174 (FIG. 4) applied to the set input 212. The state of latch 210 is transferred via latch output 214 and gate 216 to the input of left status encoder 218 during interval T2. Thus, during T2, if the status of the associated link is normal, the left status encoder 218 will provide a status normal output to the transceiver 78 for transmission to the central station 82. Note that the output of gate 216 is connected to the reset input terminal 220 of latch 210. Accordingly, in order for the transceiver 78 to continue to send a status normal output to the central station 82, the receiver section must provide STATUS NORMAL outputs 174 at least as frequently as the sector module 28 is interrogated.

If interrogate decoder 182 recognizes a test, rather than a normal, interrogate command from transceiver 78, it activates the self test circuit 221, via gate 223 at interval T1. The circuit 221 then applies a test response to the transceiver 78.

Figure 6:
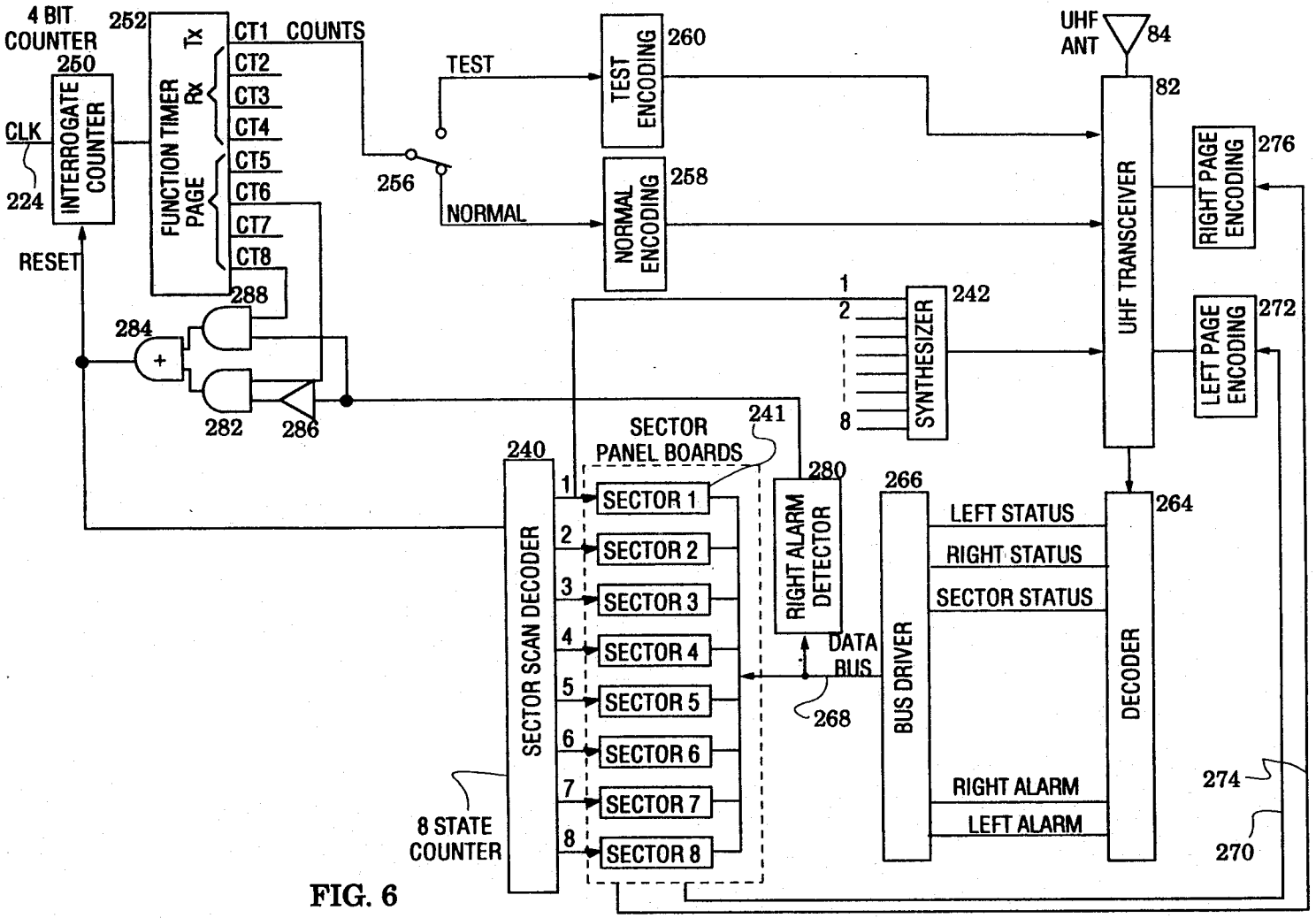
FIG. 6 is a block diagram of a preferred central station.
Figure 7:
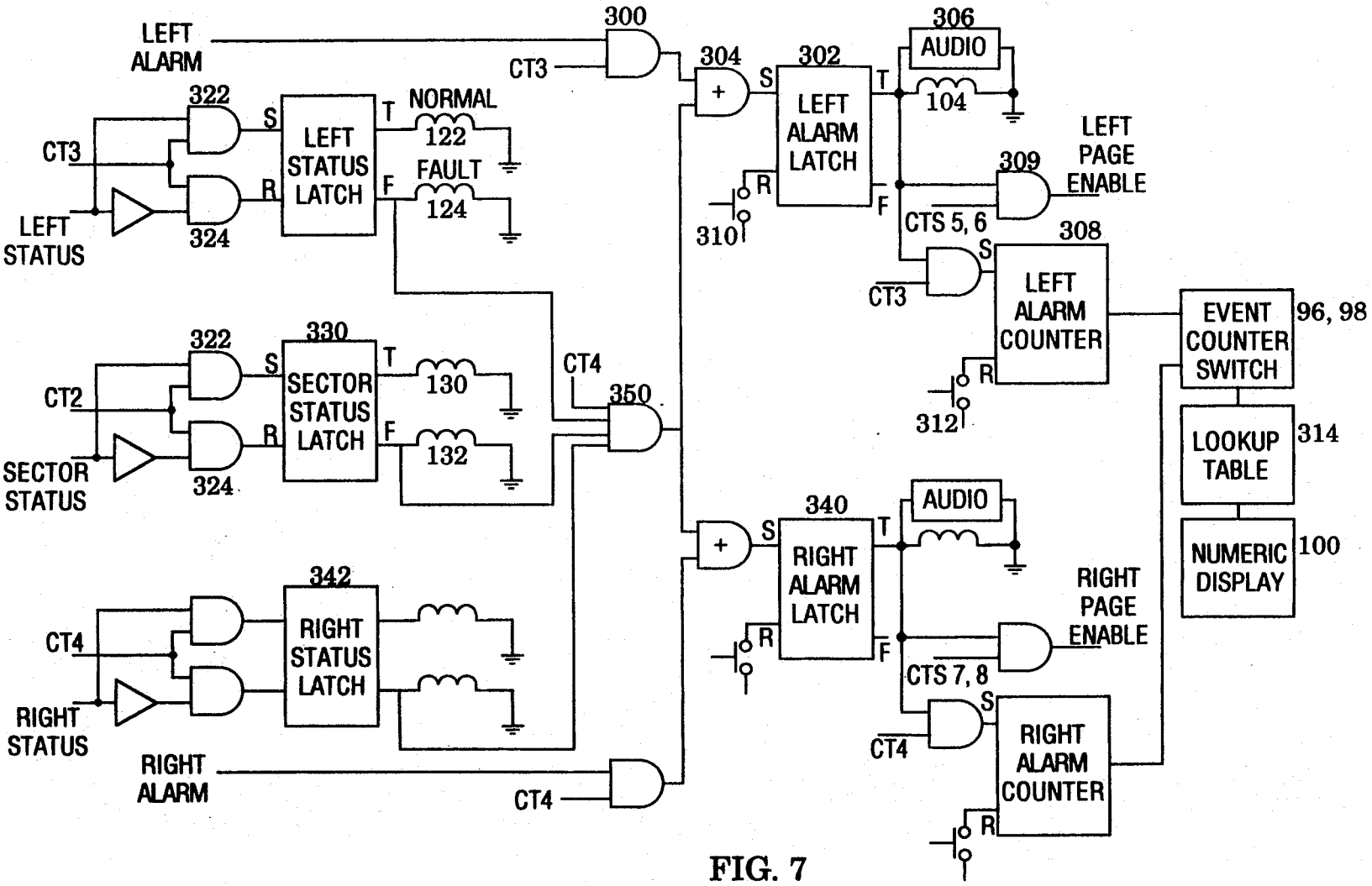
FIG. 7 is a block diagram of a preferred sector panel board.
Figure 8:
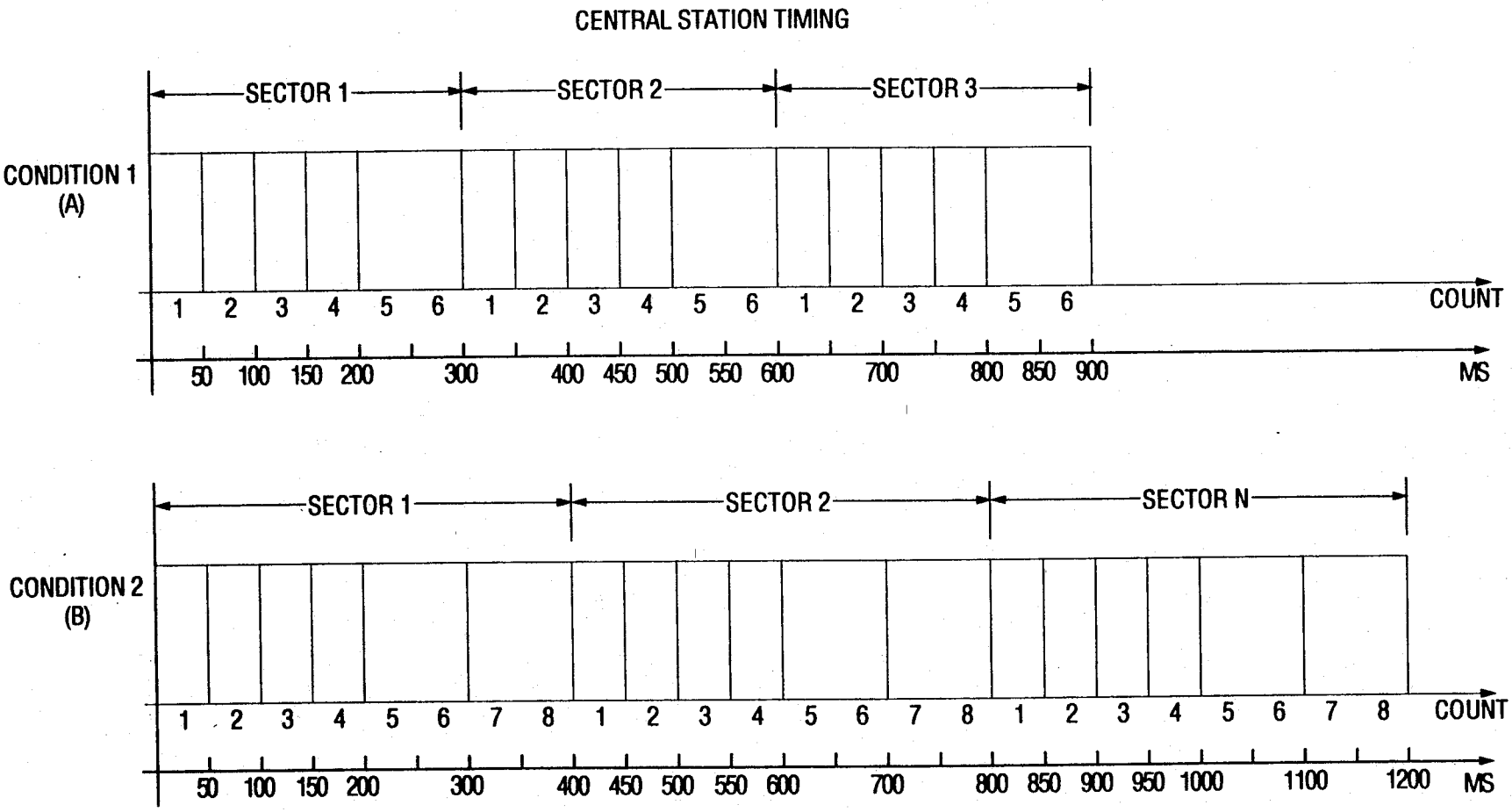
FIG. 8 is a system timing diagram.

Before proceeding to a description of the preferred central station implementation depicted in FIGS. 6 and 7, attention is called to FIG. 8 which illustrates control station timing. Line (A) of FIG. 8 depicts that the control station 82 (FIGS. 6,7) interrogates the sector modules 28 sequentially; i.e. sectors 1,2, . . . N, 1,2, . . . . During each sector count (or interval) represented in FIG. 8, multiple timer counts are sequentially defined during which different functions are performed. These will be discussed in detail in connection with FIGS. 6,7 and 9. Suffice it to note at this point that each sector interval of line (A) of FIG. 8 contains six timer counts (1–6). Line (B) of FIG. 8 depicts each sector interval containing eight timer counts (1–8). Line (A) represents the more normal situation in which the interrogated sector reports no alarms or a sector left alarm only. In this situation, timer counts 7 and 8 (which as will be seen hereinafter as used to process right alarms) are aborted. Line (B) represents the condition in which a right alarm is reported.

Attention is now directed to FIG. 6 which depicts a block diagram of a preferred control station implementation in accordance with the invention. Initially note eight state counter 240 which sequentially and cyclically defines sector counts 1–8. Each count enables a different one of the eight sector panel boards 241. During each different sector count, synthesizer 242 will define a different (i.e. unique) UHF frequency to control station transceiver 82. Within each sector count, interrogate counter 250 and decoder 252 will define eight different timer counts CT1–CT8. The interrogate counter 250 is driven by a free running clock input 224.

Note from FIG. 6 that decoder 252 CT1 output is connected to a mode select switch 256, switchable between a test mode and a normal mode. If switch 256 defines the normal mode, then the CT1 output will enable the normal encoding circuit 258 to encode a normal interrogate signal (e.g. tone) to the UHF carrier generated by synthesizer 242. If on the other hand, switch 256 defines the test mode, then encoding circuit 260 will be activated instead of encoding circuit 258, to define a test interrogate signal, rather than a normal interrogate. It will be recalled from FIG. 5 that decoder 182 distinguishes between there two interrogate signals.

Transmissions from the interrogated sector module are transferred from transceiver 82 to decoder circuit 264 which develops left and right status outputs, left and right alarm outputs, and a sector status output.

These are applied to bus driver 266 and then via data bus 268 to the enabled sector panel board. As will be seen hereinafter, status and alarm outputs are received during timer counts CT2–4 defined by decoder 252.

During timer counts CT5,6, the left link information transferred into the enabled sector panel board 241 will be supplied via cable 270 to the left page encoding circuit 272 for transmission to the aforementioned central remote receiver 134 (FIG. 1). During timer counts CT7,8, the status and alarm information for the right link will be transferred via cable 274 to the right page encoding circuit 276.

Note that a right alarm detector 280 is provided to monitor the right alarm information applied to the data bus 268 from bus driver 266. Assuming the absence of detected right alarm information, then count CT6 will enable gate 282 to reset (via gate 284) interrogate counter 250. This action implements the condition previously mentioned in conjunction with line (A) of FIG. 8 wherein it was pointed out that if no right alarm occurs, then the timer counts during each sector interval will be truncated after count CT6. If on the other hand, right alarm detector 280 detects right alarm information on the data bus 268, then gate 282 will be inhibited as a consequence of invertor 286, and instead gate 288 will be enabled during timer CT8 to reset the interrogate counter 250.

Attention is now directed to FIG. 7 which depicts a preferred implementation of a sector panel 241. Note that the left alarm information from data bus 268 is gated at timer count CT3 (gate 300) into the set input terminal of left alarm latch 302 via gate 304. When the latch 302 is set, its true output energizes the left alarm indicator 104 (FIG. 2A and FIG. 7) and an audio device 306 is also energized. Moreover, the setting of latch 302 increments an accumulating left alarm counter 308. Reset switches 310 and 312 are provided respectively to reset latch 302 and counter 308. It was previously mentioned in conjunction with FIG. 2A that event counter switches 96,98 are provided for each sector to read out an accumulated alarm count into numeric display 100. This is represented in FIG. 7 by event counter switches 96, 98 which couple the accumulated value in alarm counter 308 through a look up table module 314 to energize the appropriate numeric elements in display 100.

The left status information placed on the data bus 268, at timer count CT3 either sets (normal) or resets (fault) left status latch 320 via gates 322 and 324. If the latch 320 is set, then the left normal status indicator 122 (FIG. 2A) is energized. If the latch 320 is reset, then the fault status indicator 124 is energized.

Whereas the left alarm and status information is handled during count CT3, the sector status information applied to data bus 268 is used during count CT2 to either set (normal) or reset (fault) the status latch 330 via gates 332 and 334. The sector status latch 330 will then energize normal indicator 130 or fault indicator 132 depending on its state.

At count CT4, the right alarm and right status data from data bus 268 are read into the right alarm latch 340 and right status latch 342 which functions in the same manner as the aforediscussed left alarm and left status latch 302,320 respectively.

In the event all of the status latches, i.e. left, sector, and right, indicate a fault condition, this will be considered an alarm condition. In order to implement this, the false outputs of the latches 320, 330, and 342 are connected to gate 350. Gate 350 is enabled at count CT4 to thus set alarm latches 302 and 340.

Figure 9A:
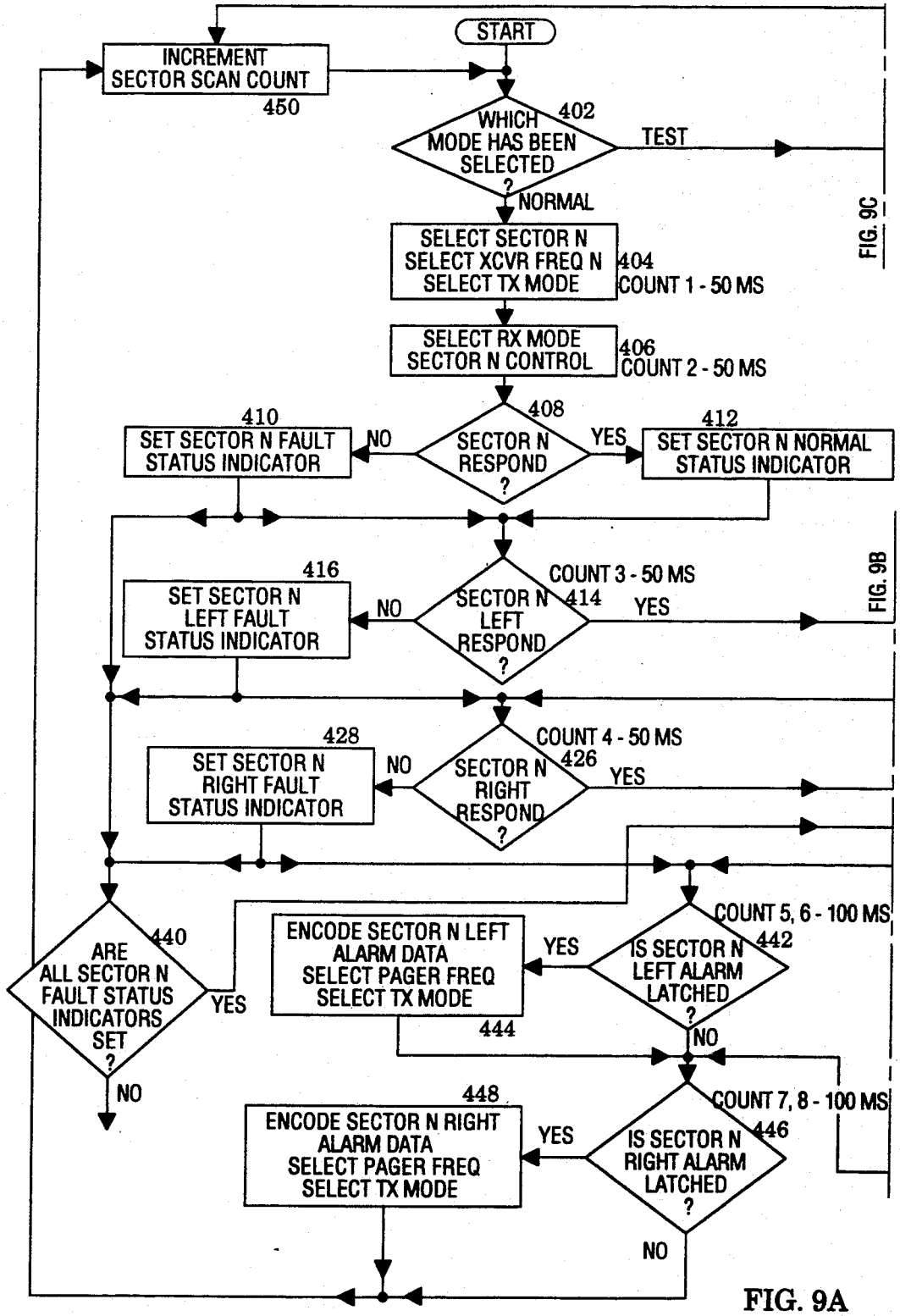
FIGS. 9A, 9B, and 9C together comprise a flow chart describing the operation of the central station.
Figure 9B:
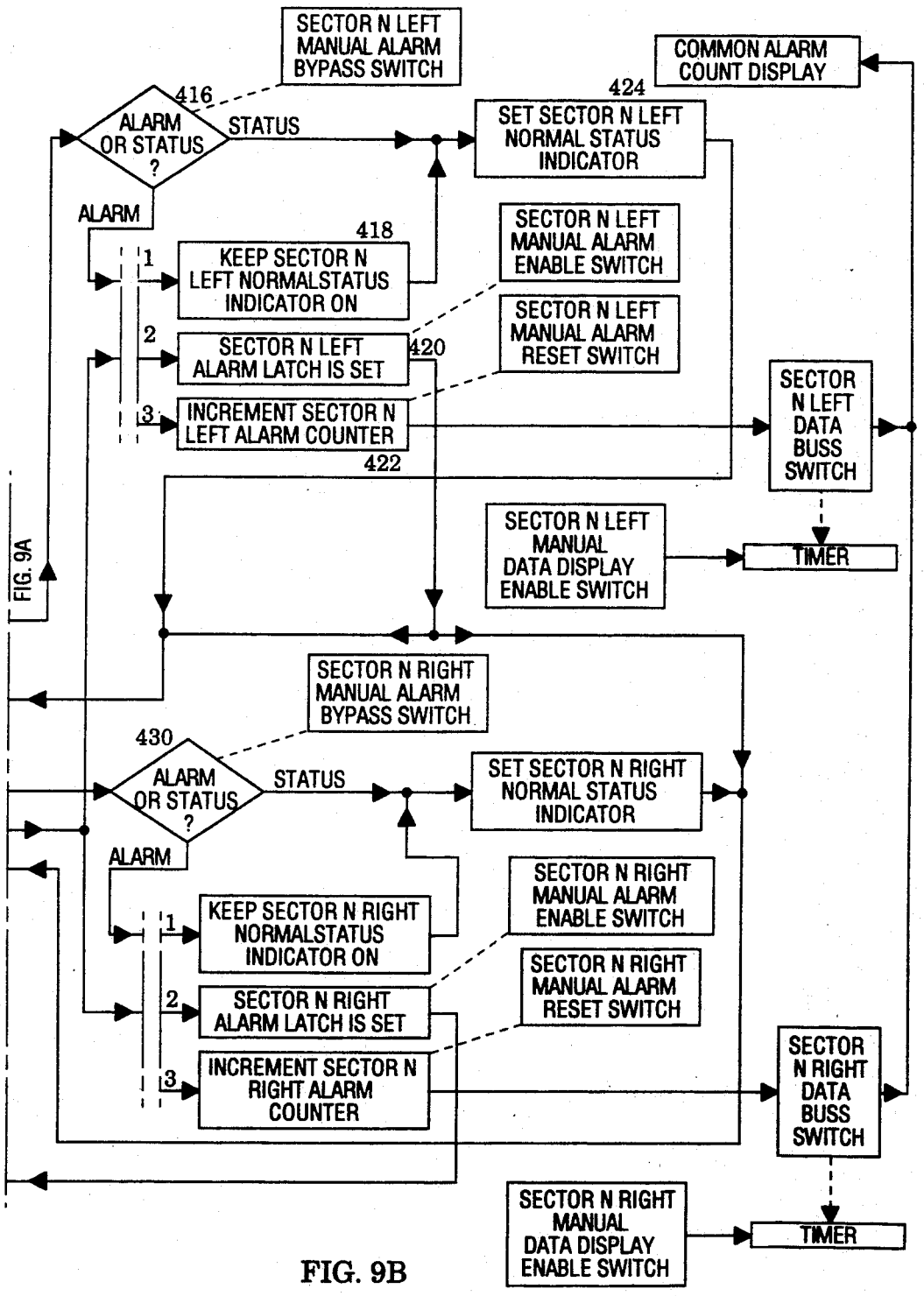
Figure 9C:
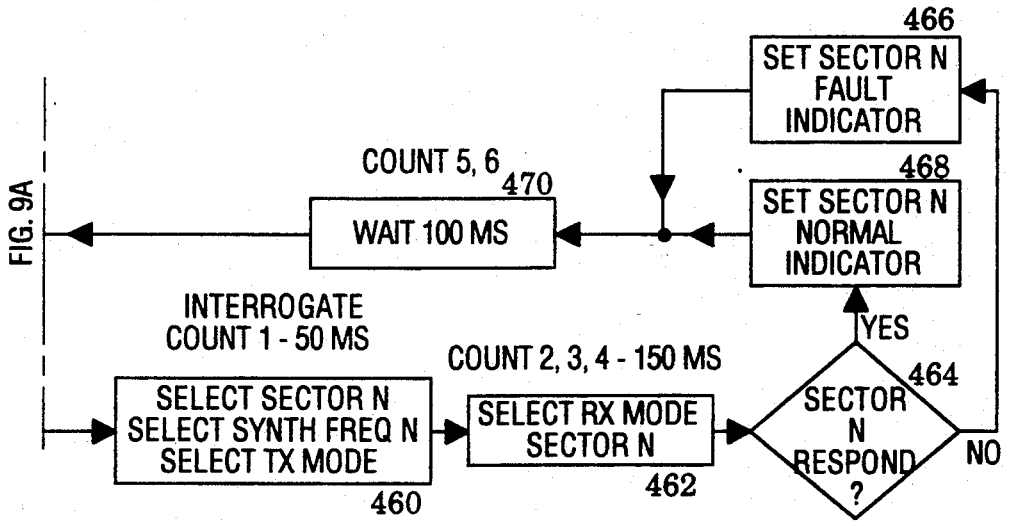

Attention is now directed to FIGS. 9A, 9B, and 9C which describe the operation of the station control of FIGS. 6 and 7 in flow chart form. The initial decision block 402 determines whether the interrogation is to be a normal or test interrogation. This is implemented in switch 256. If a normal interrogation, then during timer count CT1, the synthesizer 242 will select the appropriate sector frequency, block 404. Thereafter, block 406, the transceiver will be in the receive mode to determine whether the interrogated sector responded, block 408. If the interrogated sector did not respond, the sector fault status indicator is set via latch 330, block 410. If the interrogated sector did respond, then the latch 330 sets the normal status indicator 130, block 412. Thereafter, at timer count CT3, decision block 414 determines whether a left status response was received. If not, the left status fault indicator 124 is energized via left status latch 320, block 416. If decision block 414 determines that a left response has been received, then decision block 416 determines whether the response was an alarm or status. If an alarm response, then the following actions are taken:

1. The left normal status indicator 122 is maintained on, block 418.
2. The left alarm latch 302 is set, block 420.
3. The left alarm counter 308 is incremented, block 422.

If block 416 indicates a status response, then the left status latch 320 is set to energize the normal status indicator 122, block 424. After execution of blocks 418, 420, 422 and/or block 424, the flow returns to decision block 426 at count CT4. Decision block 426 with respect to the right link is analogous to the aforediscussed decision block 414 with respect to the left link. If decision block 426 determines receipt of a fault for the right link, then right fault status indicator 128 is set (block 428). If no status fault is detailed, decision block 426 leads to decision block 430, analogous to the aforediscussed block 416.

Note that if, as a consequence of blocks 410, 416 and 428, all three status indicators for the left, right and sector are indicating a fault status, then block 440 (implemented by gate 350 in FIG. 7) causes an alarm condition, just as if both blocks 416 and 430 were responding to a received alarms. This action of course energizes lights 104, 106 (FIG. 2A) in addition to lights 124, 132, 128.

Still continuing with respect to FIG. 9A, during counts CT5, 6 decision block 442 determines whether the sector left alarm (302) has been latched. If yes, then the left alarm data is encoded and transmitted to the central remote receiver, implemented by gate 309 (FIG. 7) and encoder 276 (FIG. 6). This action is represented by block 444.

At counts CT7,8 decision block 446 determines whether the right alarm latch (340) has been set. If yes, block 448 then encodes alarm data (encoder 272, FIG. 6). After decision block 446 the eight state counter 240 is incremented, (block 450), implemented by the output of gate 284 (FIG. 6).

Returning to decision block 402 of FIG. 9A, if switch 256 (FIG. 6) directs that a test mode interrogate command be executed, rather than a normal mode interrogate, then operation would flow from block 402 to block 460. Block 460 involves selecting a UHF frequency implemented by synthesizer 242 during timer count CT1. During counts CT2, 3, 4 block 462 indicates that the transceiver operates to receive any transmission from the interrogated sector. If the sector fails to respond, block 464, then the sector fault indicator (132) is energized block 466. If the sector does respond, the normal indicator 130 is energized, block 468. In either event, after a wait of 100 milliseconds equivalent to counts CT5, 6 block 470, operational flow then returns to block 450 to increment the sector scan count, that is counter 240.

From the foregoing, it will now be recognized that an intrusion detection system has been disclosed herein in which multiple bistatic links can be efficiently remotely interrogated to indicate to an operator at a central station the status and alarm condition at each link. Moreover, the central station operator is able to readily see the number of accumulated intrusions for each link. Still further, the status and alarm information for each link is rapidly and automatically communicated to field personnel.

Although, a preferred implementation of the invention has been disclosed herein, it will be recognized by those skilled in the art that various changes and modifications can be made, all falling within the intended scope of the appended claims.

I claim:

1. An intrusion detection system comprising:

a plurality of microwave links, each defined by an operationally coupled transmitter and receiver, deployed to define a detection boundary;

said transmitter including an antenna for transmitting a microwave carrier signal, a status encoder for applying normal status information to said carrier signal representative of a normal operational status of that transmitter, and fault mirror means responsive to a fault condition at that transmitter for inhibiting the application of said normal status information to said carrier signal;

said receiver including an antenna oriented to receive said microwave carrier signal from the transmitter operationally coupled thereto, a processor for producing an alarm output responsive to an intrusion across the link associated with that receiver, and a status decoder for producing a status normal output responsive to said normal status information carried by said carrier signal; and central station means located remote from said receiver and in wireless communication therewith for displaying the alarm outputs produced for each link.

2. The system of claim 1 wherein said receiver includes means for producing a status output representative of the operational status of that receiver; and wherein said receiver includes an RF transceiver means for transmitting alarm and status output information to said central means.

3. The system of claim 2 wherein said central station means includes RF transceiver means and means for periodically interrogating said receiver to initiate transmission of alarm and status information therefrom.

4. The system of claim 1 further including portable central receiver means adapted to be carried by field personnel, said central receiver means including display means for displaying alarm output information with respect to each link, and wherein, said central station means remotely controls said central receiver means display means.

5. The system of claim 2 wherein said central station means includes means for displaying an accumulated alarm count representative of the number of intrusions across the associated link.

6. The system of claim 5 wherein each receiver includes alarm counter means;

means for incrementing said alarm counter means in response to each alarm output produced by said processor means; and means for decrementing said alarm counter means when said alarm output information is transmitted to said central station.

7. The system of claim 2 wherein each of said transceiver means includes means for selecting a unique RF carrier frequency.

8. A sector set for use in an intrusion detection system, said sector set comprising:

a sector module;

first and second transmit modules, said transmit modules intended to be deployed remotely from said sector module and from one another;

said sector module including first and second receive sections each having a receive antenna adapted to be microwave coupled to said first and second transmit modules, respectively, to define left and right microwave links;

each of said transmit modules having (1) a transmit antenna and transmitter means connected thereto for transmitting a microwave carrier, and (2) means for applying status information to said carrier representative of the operational status of that transmit module;

each of said receive sections including processor means for producing alarm output information responsive to an intrusion across the link associated with that receive section and status decode means for producing status output information representative of the operational status of the transmit module coupled thereto;

each of said transmit modules including a battery operated power supply and solar panel means for charging said power supply.

9. The apparatus of claim 8 wherein said sector module further includes means for producing status output information representative of the operational status of each of said receive sections.

10. The apparatus of claim 9 further including:

RF transmitter means; and means for periodically supplying said alarm and status output information to said RF transmitter means for transmission to a central monitoring station.

11. The apparatus of claim 9 wherein said sector module further includes:

RF transceiver means for receiving communications from and transmitting communications to a central monitoring station; and means responsive to receipt of an interrogation communication for transmitting alarm and status output information to said central monitoring station.

12. The sector set of claim 11 wherein said sector module includes first and second alarm counter means respectively coupled to said first and second receive sections;

means for incrementing each of said alarm counter means in response to the receive section coupled thereto producing alarm output information; and means for decrementing each of said alarm counter means when said alarm output information is transmitted to said central monitoring station.

13. An intrusion detection system comprising: a plurality of sector sets, each including a sector module and first and second transmit modules located remotely from said sector modules and from one another;

said sector module including first and second receive sections each having a receive antenna adapted to be microwave coupled to said first and second transmit modules, respectively, to define left and right microwave links;

each of said transmit modules having (1) a transmit antenna and transmitter means connected thereto for transmitting a continuous microwave carrier, and (2) means for applying status information to said carrier representative of the operational status of that transmit module;

each of said receive sections including processor means for producing alarm output information responsive to an intrusion across the link associated with that receive section and status decode means for producing status output information representative of the operational status of the transmit module coupled thereto;

said sector module further including means for producing status output information representative of the operational status of each of said receive sections;

central station means; and wherein said sector module includes RF transmitter means for generating a unique RF carrier and means for applying said alarm and status output information to said carrier for transmission to said central station means.

14. The system of claim 13 wherein said sector module and said first and second transmit modules includes rechargeable battery means; and wherein said sector module includes solar panel means for charging said battery means.

15. The system of claim 13 further including RF receiver means in each of said sector modules;

said central station means including RF transmitter means for periodically transmitting an interrogation signal to each of said sector modules; and means in said sector module responsive to said interrogation signal for activating its RF transmitter means.

16. The system of claim 15 wherein said central station means includes means for displaying an accumulated alarm count representative of the number of intrusions across each of said microwave links.

17. The system of claim 16 wherein said central station means includes means for displaying the operational status of each of said microwave links.

18. The system of claim 17 further including portable central receiver means adapted to be carried by field personnel, said central receiver means including display means for displaying alarm output information with respect to each link, and wherein, said central station means remotely controls said central receiver means display means.

19. An intrusion detection system comprising:

a plurality of remotely located sector sets, each sector set including a sector module and first and second transmit modules located remotely from said sector module and from one another;

said sector module including first and second receive sections each having a receive antenna adapted to be microwave coupled to said first and second transmit modules, respectively, to define left and right microwave links;

each of said transmit modules having a transmit antenna and transmitter means connected thereto for transmitting a microwave carrier;

each of said receive sections including processor means for producing alarm output information responsive to an intrusion across the link associated with that receive section;

said sector module further including RF transceiver means;

central station means including RF transceiver means for sequentially transmitting interrogation signals to said plurality of sector sets; and means in each sector module responsive to a selected interrogation signal for activating its RF transceiver means to transmit alarm output information to said central station means.

20. The system of claim 19 wherein said central station means includes means for displaying an accumulated alarm count representative of the number of intrusions across each of said microwave links.

21. The system of claim 20 further including portable central receiver means adapted to be carried by field personnel, said central receiver means including display means for displaying alarm output information with respect to each link, and wherein, said central station means remotely controls said central receiver means display means.

* * * * *